US008679261B2

(12) United States Patent
Brunswick et al.

(10) Patent No.: US 8,679,261 B2
(45) Date of Patent: Mar. 25, 2014

(54) BOX-TYPE WAREWASHER INCLUDING HEAT RECOVERY SYSTEM FOR REDUCING AIR MOISTURE LEVEL AT THE END OF CYCLE

(75) Inventors: Brian A. Brunswick, Tipp City, OH (US); Michael S. D'Fantis, Madeconia, OH (US); David Lawrence Fischer, Fairborn, OH (US); Joshua A. Fortman, Knoxville, TN (US); Thomas A. Grueser, Donnelsville, OH (US); Todd M. Kerlin, Lima, OH (US); Catherine A. Mencsik Lucas, Dayton, OH (US); James D. Rice, Jr., Miamisburg, OH (US); Craig S. Rohren, Dayton, OH (US); Benjamin J. Shappie, Versailles, OH (US); Benjamin A. Stroup, Tampa, FL (US); John D. Thompson, Sewickley, PA (US); Charles E. Warner, Troy, OH (US)

(73) Assignee: Premark FEG L.L.C., Glenview, IL (US)

( * ) Notice: Subject to any disclaimer, the term of this patent is extended or adjusted under 35 U.S.C. 154(b) by 765 days.

(21) Appl. No.: 12/684,204

(22) Filed: Jan. 8, 2010

(65) Prior Publication Data

US 2010/0294323 A1 Nov. 25, 2010

Related U.S. Application Data

(60) Provisional application No. 61/169,545, filed on Apr. 15, 2009.

(51) Int. Cl.
*B08B 3/00* (2006.01)

(52) U.S. Cl.
USPC ..... 134/57 D; 134/56 D; 134/58 D; 134/105; 134/107

(58) Field of Classification Search
USPC ..... 134/56 D, 105, 107
See application file for complete search history.

(56) References Cited

U.S. PATENT DOCUMENTS 3,068,877 A * 12/1962 Jacobs ..... 134/99.1
3,598,131 A 8/1971 Weibe, Jr. et al.

(Continued)

FOREIGN PATENT DOCUMENTS

CA 2607829 A1 * 11/2006 ..... B08B 3/00
GB 1486725 9/1977

(Continued)

OTHER PUBLICATIONS

PCT, International Preliminary Report on Patentability, International Application No. PCT/US2010/030666 (Oct. 27, 2011).

(Continued)

*Primary Examiner* — Joseph L Perrin
*Assistant Examiner* — Levon J Shahinian
(74) *Attorney, Agent, or Firm* — Thompson Hine LLP

(57) ABSTRACT

A box-type warewasher includes a housing defining an internal treatment space for receiving wares to be washed and a liquid sump below the treatment space. A wash liquid delivery system includes a wash pump having an input connected to the liquid sump and an output connected to deliver liquid to one or more spray nozzles of the treatment space. A rinse liquid delivery system includes a rinse pump for delivering rinse water to one or more spray nozzles of the treatment space. A condensing system includes a heat exchanger external of the treatment space, and a blower for moving hot moist air from the treatment space across the heat exchanger and back to the treatment space. A controller effects operation of each of the wash liquid delivery system, the rinse liquid deliver system and the condensing system. The controller is configured for carrying out at least one ware cleaning sequence in which: a wash spray operation is carried out by operating the wash pump; subsequent to the wash spray operation a rinse spray operation is carried out by operating the rinse pump; and subsequent to the rinse spray operation a condensing operation is carried out by operating the blower.

15 Claims, 5 Drawing Sheets

(56) References Cited

U.S. PATENT DOCUMENTS

| | | | | |
|---|---|---|---|---|
| 3,789,860 | A | 2/1974 | Katterheinrich et al. | |
| 4,098,616 | A | 7/1978 | Dorius et al. | |
| 4,326,551 | A | 4/1982 | Voorhees | |
| 5,355,900 | A * | 10/1994 | Sakata | 134/95.2 |
| 5,660,193 | A | 8/1997 | Archer et al. | |
| 7,103,992 | B2 * | 9/2006 | Duden et al. | 34/381 |
| RE40,123 | E | 3/2008 | Johansen et al. | |
| 2004/0187339 | A1 | 9/2004 | Duden et al. | |
| 2004/0261820 | A1 * | 12/2004 | Monsrud et al. | 134/10 |
| 2010/0186776 | A1 | 7/2010 | Bittner | |

FOREIGN PATENT DOCUMENTS

| | | |
|---|---|---|
| GB | 2030446 | 4/1980 |
| WO | WO 2006/063895 | 6/2006 |

OTHER PUBLICATIONS

PCT, International Search Report and Written Opinion; 15 pages (Jul. 8, 2010).

* cited by examiner

BOX-TYPE WAREWASHER INCLUDING HEAT RECOVERY SYSTEM FOR REDUCING AIR MOISTURE LEVEL AT THE END OF CYCLE

CROSS-REFERENCES

This application claims the benefit of U.S. Provisional Application Ser. No. 61/169,545, filed Apr. 15, 2009, the entirety of which is hereby incorporated by reference.

TECHNICAL FIELD

This application relates generally to warewasher systems which are used in commercial applications such as cafeterias and restaurants and, more particularly, to such a warewasher system including a heat recovery system for removing heat and moisture from hot moist air in the machine at the end of a cleaning cycle.

BACKGROUND

Dishwashers, in particular commercial dishwashers, in the form of a box-type warewasher (aka batch-type or door-type warewasher) may, by way of example, be hood-type warewashers or front-loader warewashers. In both cases, wares are loaded into a treatment space in batch-form through an opening, wash and rinse operations are applied to the wares sequentially while the wares sit in the same, single treatment space or zone, and the wares are then removed from the treatment space, again in batch-form, to make room for a next batch/load of ware. Front-loader warewashers, by way of example, may be under-counter machines or top-counter machines or built-in-counter machines. A given box-type machine may be constructed to handle a variety of ware types or to specifically handle primarily certain types of ware (e.g., glasswashers or pot and pan washers).

Box-type machines that wash and rinse with hot water (e.g., 150°-160° F. wash & 180° F. rinse) commonly require a ventilation system at the installation site to remove the hot, moist air emitted from the warewasher after a cycle is completed. After the ware is cleaned and sanitized, the door is opened releasing a plume of hot, moist air into the room. As a result, vent hoods are commonly required to eliminate this excess heat and humidity.

For some locations it is undesirable to install a ventilation hood due to the cost or building constraints. In these cases the customer may purchase a low temperature warewasher to eliminate the need. However, most customers prefer the performance achieved by high temperature machines.

SUMMARY

In one aspect, a box-type warewasher for washing wares includes a housing defining an internal treatment space for receiving wares to be washed and a liquid sump below the treatment space. A wash liquid delivery system provides a spray of liquid within the treatment space, and includes a wash pump having an input connected to the liquid sump and an output connected to deliver liquid to one or more spray nozzles of the treatment space. A rinse liquid delivery system includes a rinse pump for delivering rinse water to one or more spray nozzles of the treatment space. A closed loop heat recovery system recovers heat from hot moist air present in the treatment space, and includes a heat exchanger external of the treatment space, and a blower for moving hot moist air from the treatment space across the heat exchanger and back to the treatment space.

In another aspect, a box-type warewasher for washing wares includes a housing defining an internal treatment space for receiving wares to be washed, a liquid sump below the treatment space, a door associated with the housing for moving wares into and out of the treatment space. A wash liquid delivery system provides a spray of liquid within the treatment space, and includes a wash pump having an input connected to the liquid sump and an output connected to deliver liquid to one or more spray nozzles of the treatment space. A rinse liquid delivery system includes a rinse pump for delivering rinse water to one or more spray nozzles of the treatment space. A condensing system removes moisture from air present in the treatment space, and includes a heat exchanger external of the treatment space, and a blower for moving hot moist air from the treatment space across the heat exchanger and back to the treatment space. A controller effects operation of each of the wash liquid delivery system, the rinse liquid deliver system and the condensing system. The controller is configured for carrying out at least one ware cleaning sequence in which: a wash spray operation is carried out by operating the wash pump; subsequent to the wash spray operation a rinse spray operation is carried out by operating the rinse pump; and subsequent to the rinse spray operation a condensing operation is carried out by operating the blower.

The details of one or more embodiments are set forth in the accompanying drawings and the description below. Other features, objects, and advantages will be apparent from the description and drawings, and from the claims.

DETAILED DESCRIPTION

Figure 1:
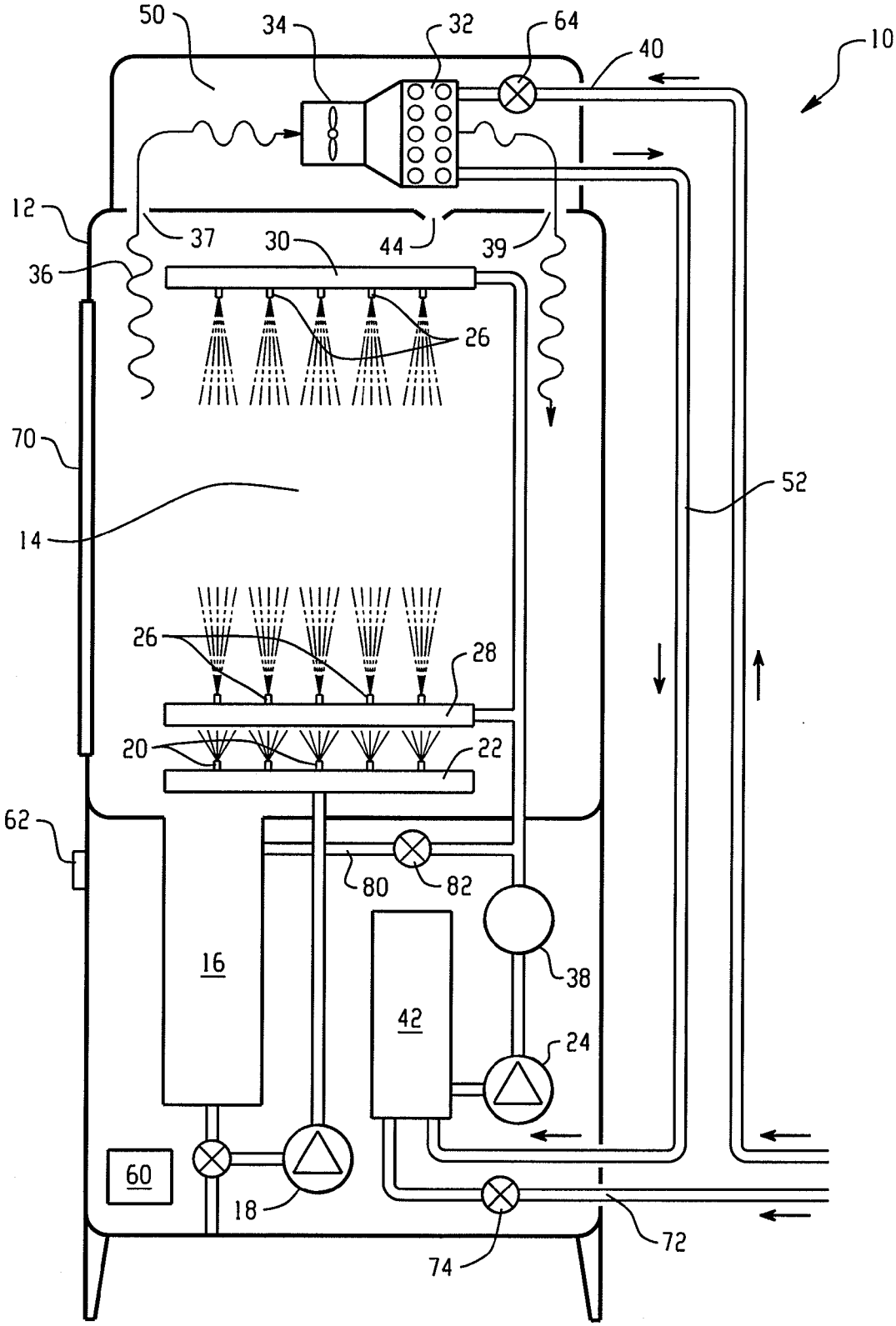
FIG. 1 is a schematic depiction of one embodiment of a dishwasher.

In one example, a box-type warewasher 10 for washing wares includes a housing 12 defining an internal treatment space 14 for receiving wares to be washed and a liquid sump 16 below the treatment space. A wash liquid delivery system provides a spray of liquid within the treatment space, and includes a wash pump 18 having an input connected to the liquid sump 16 and an output connected to deliver liquid to one or more spray nozzles 20 of the treatment space (e.g., nozzles in a stationary or rotating arm 22). A rinse liquid delivery system includes a rinse pump 24 for delivering rinse water to one or more spray nozzles 26 of the treatment space (e.g., nozzles located in stationary or rotating arms 28 and 30). A closed loop heat recovery system is provided for recovering heat from hot moist air present in the treatment space 14. The heat recovery system includes a heat exchanger 32 external of the treatment space, and a blower 34 for moving hot moist air 36 from the treatment space across the heat exchanger and back to the treatment space.

The rinse liquid delivery system may include a booster heater 38. The rinse pump delivers water from the booster heater to one or more spray nozzles 26 of the treatment space. The booster heater may include a gas or electric heating element.

A cold water input 40 may be connected to deliver cold water (e.g., water at the temperature of incoming tap water to the facility) to the heat exchanger such that heat recovered from hot moist air is transferred to the cold water, and a rinse water reservoir 42 may be provided to receive the heated water from the heat exchanger. The rinse water reservoir is connected to deliver water to the booster heater 38 via the pump 24. Heated water from the heat exchanger may typically be at least 15 degrees F. hotter than the cold water delivered to the heat exchanger, and preferably at least 30 degrees F. hotter, and more preferably at least 40 degrees F. hotter (e.g., in the range of 50-90 degrees F. hotter). Cold water delivered to the heat exchanger is typically in a temperature range of about 50 to 60 degrees F., and heated water from the heat exchanger is typically in a temperature range of about 70 to 80 degrees F. or higher, preferably at least 110 degrees F., and more preferably at least 130 degrees F. (e.g., about 140 degrees F.).

Figure 2:
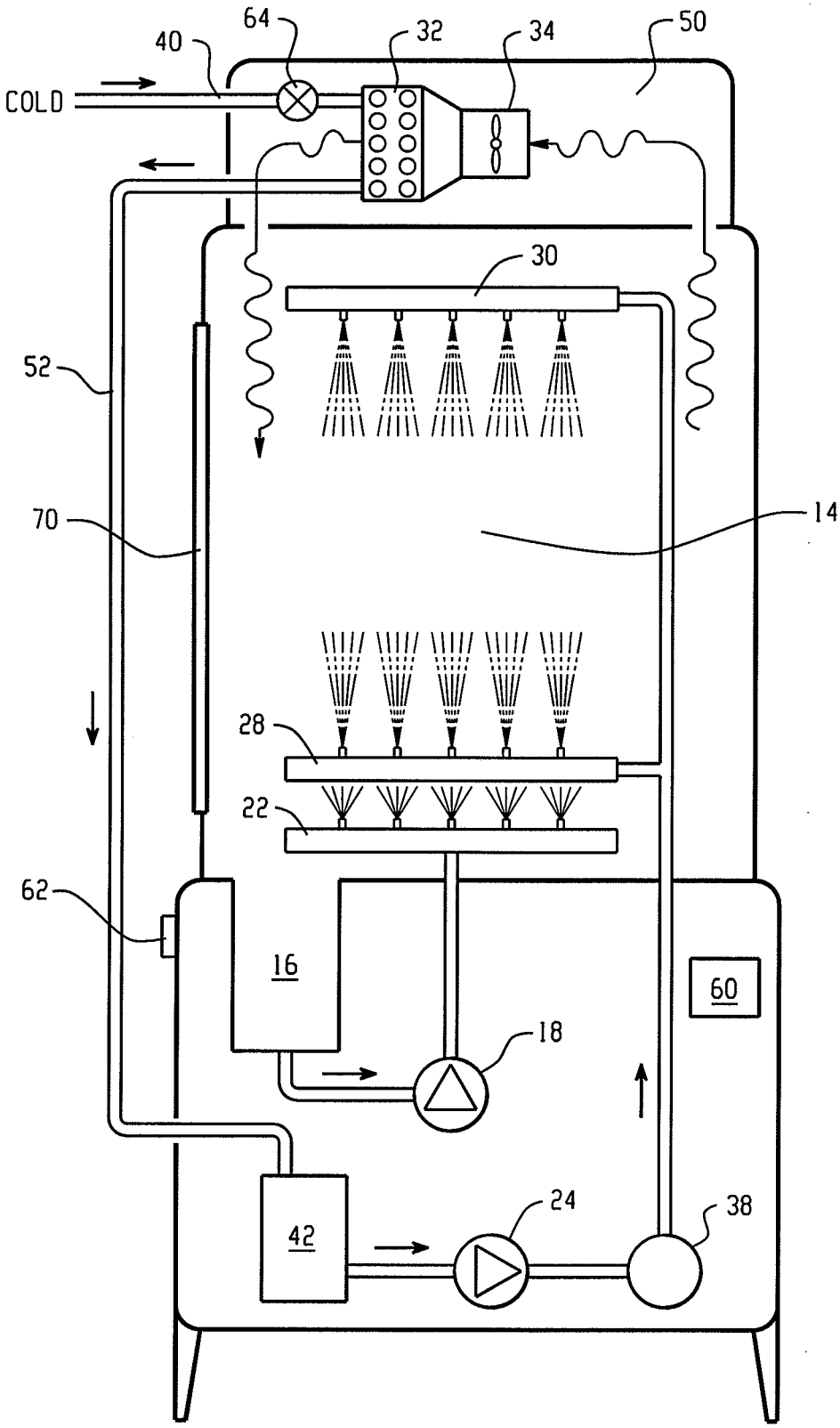
FIG. 2 is a schematic depiction of another embodiment of a dishwasher.

In one implementation (such as those of FIG. 1 and FIG. 2), the heat exchanger 32 may located in a heat exchange compartment 50 above the treatment space and the blower 34 circulates hot moist air from the treatment space upward into the heat exchange compartment, across the heat exchanger and back down into the treatment space. The rinse water reservoir 42, rinse pump 24 and booster 38 heater are located below the treatment space or otherwise within a footprint of the machine. A heated water path 52 extends from the heat exchange compartment downward to the rinse water reservoir, and may take the form of tubing or piping that extends internally of the housing or externally of the housing. An inlet opening 37 to deliver air from the treatment space 14 into the compartment 50 may be provided toward the front of the treatment space, and an outlet opening 39 to circulate the air back into the treatment space 14 may be provided toward the rear of the treatment space (per the embodiment of FIG. 1). Alternatively, the positioning of the openings may be reversed (per the embodiment of FIG. 2). Other variations are possible. A drainage path 44 may be provided for flowing condensed moisture from the heat exchanger back into the treatment space as shown in FIG. 1. The drainage path may also be by way of one or both of the openings 37 and 39.

Figure 3:
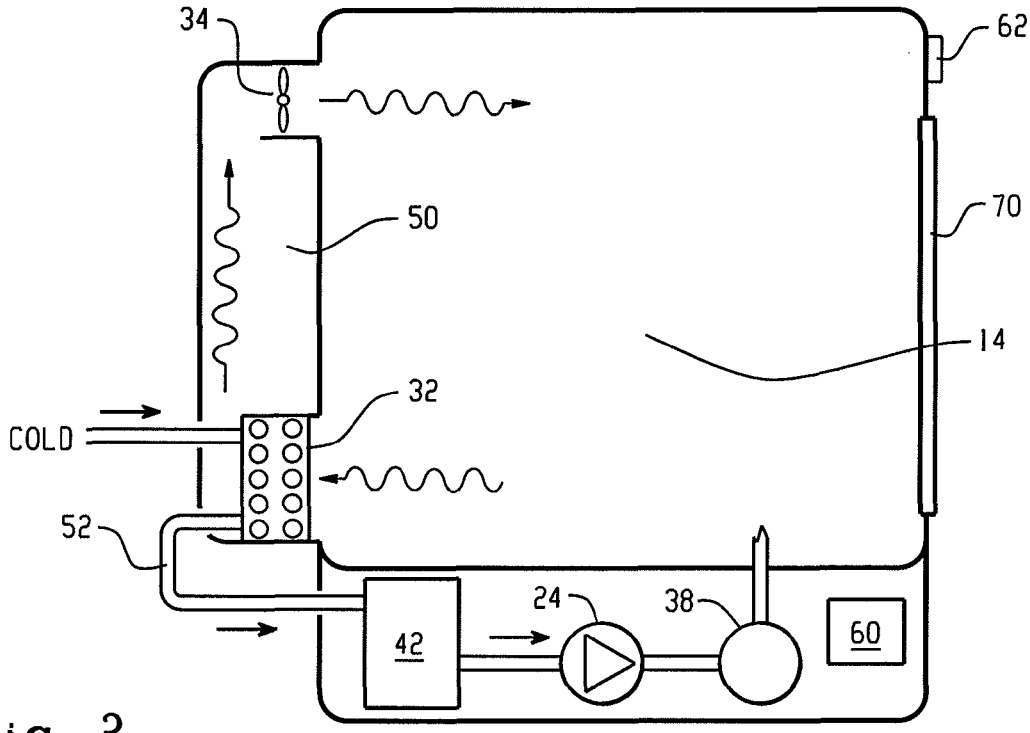
FIG. 3 is a schematic depiction of another embodiment of a dishwasher.

In another implementation (e.g., FIG. 3), the heat exchanger 32 is located in a heat exchange compartment 50 alongside the treatment space and the blower 34 circulates hot moist air from the treatment space laterally into the heat exchange compartment, across the heat exchanger and laterally back into the treatment space. The rinse water reservoir 42, rinse pump 24 and booster heater 38 are located below the treatment space or otherwise within a footprint of the machine. The heated water path 52 extends from the heat exchange compartment downward to the rinse water reservoir.

Figure 4:
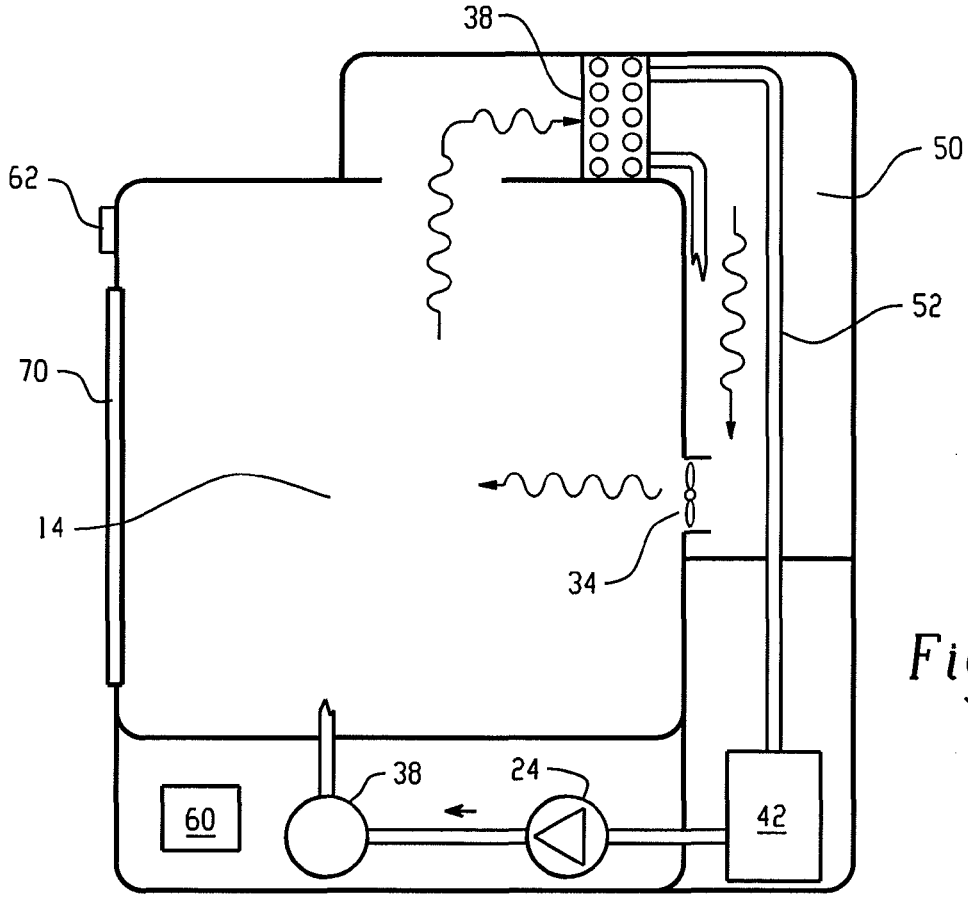
FIG. 4 is a schematic depiction of another embodiment of a dishwasher.

In yet another implementation (e.g., FIG. 4), the heat exchanger 38 is located in a heat exchange compartment 50 that extends both above the treatment space and alongside (e.g., front, back, left or right side) of the treatment space, the blower 38 circulates hot moist air from the treatment space upward into the heat exchange compartment, across the heat exchanger and laterally back into the treatment space. The rinse water reservoir 42, rinse pump 24 and booster heater 38 are located below the treatment space or otherwise within the footprint of the machine. The heated water path 52 extends from the heat exchange compartment downward to the rinse water reservoir 16.

In any variation of the machine, a programmed controller 60 may be associated with the wash liquid delivery system, rinse liquid delivery system and heat recovery system, the programmed controller configured for carrying out at least one ware treatment program sequence in which: (i) the wash liquid delivery system is operated for spraying hot wash liquid onto wares in the treatment space (e.g., hot water recirculated from the sump 16); (ii) subsequent to spraying of wash liquid, the rinse liquid delivery system is operated for spraying hot rinse liquid onto wares in the treatment space; and (iii) subsequent to spraying of rinse liquid, the heat recovery system is operated to move hot moist air from the treatment space, into the heat exchange compartment and back to the treatment space to reduce heat and humidity level in the treatment space prior to completion of the ware treatment program sequence (e.g., the controller 60 opens a valve 64 associated with the cold water inlet 40 and also turns on the blower 34). The programmed controller 60 may be configured such that the heat recovery system is operated as a final step of the ware treatment program sequence, and upon completion of the heat recovery step a cycle complete indicator 62 of the warewasher is triggered. A duration of the heat recovery step may be between about 10 seconds and about 60 seconds (e.g., between about 20 seconds and about 40 seconds). During the wash stages other than heat recovery, the blower 38 would normally be maintained in the off condition and the valve 38 closed to prevent water flow through the heat exchanger 32.

Each of the various machine configurations includes a door 70 movable between open and closed positions to provide access to the treatment space 14 for inserting and removing wares for cleaning. As shown in FIG. 1, a hot water input 72 may be provided on the machine, with an associated valve 74, enabling the controller to selectively deliver locally sourced hot water (e.g, 110 degrees F. or 140 degrees F.) to the reservoir 42 if needed (e.g., if the controller determines via a temperature indicator in the reservoir, booster, or elsewhere in the system that hotter input water to the reservoir is needed in order to obtain a desired rinse water temperature from the booster). The booster output may also be connected (e.g., via line 80 and valve 82) to selectively deliver hot water to the sump if desired.

In one example, the volume of air that travels through the heat exchange compartment during the operation of the heat recovery system at the end of the treatment sequence is between about 5 to 25 times the volume of the treatment space (e.g., 10 to 20 times the volume of the treatment space). Thus, air within the treatment space repeatedly passes through the heat exchange compartment to assure effective moisture removal. In an exemplary implementation, the volume of the treatment space may be about 5-15 cubic feet (e.g., 8-10 cubic feet).

Figure 5:
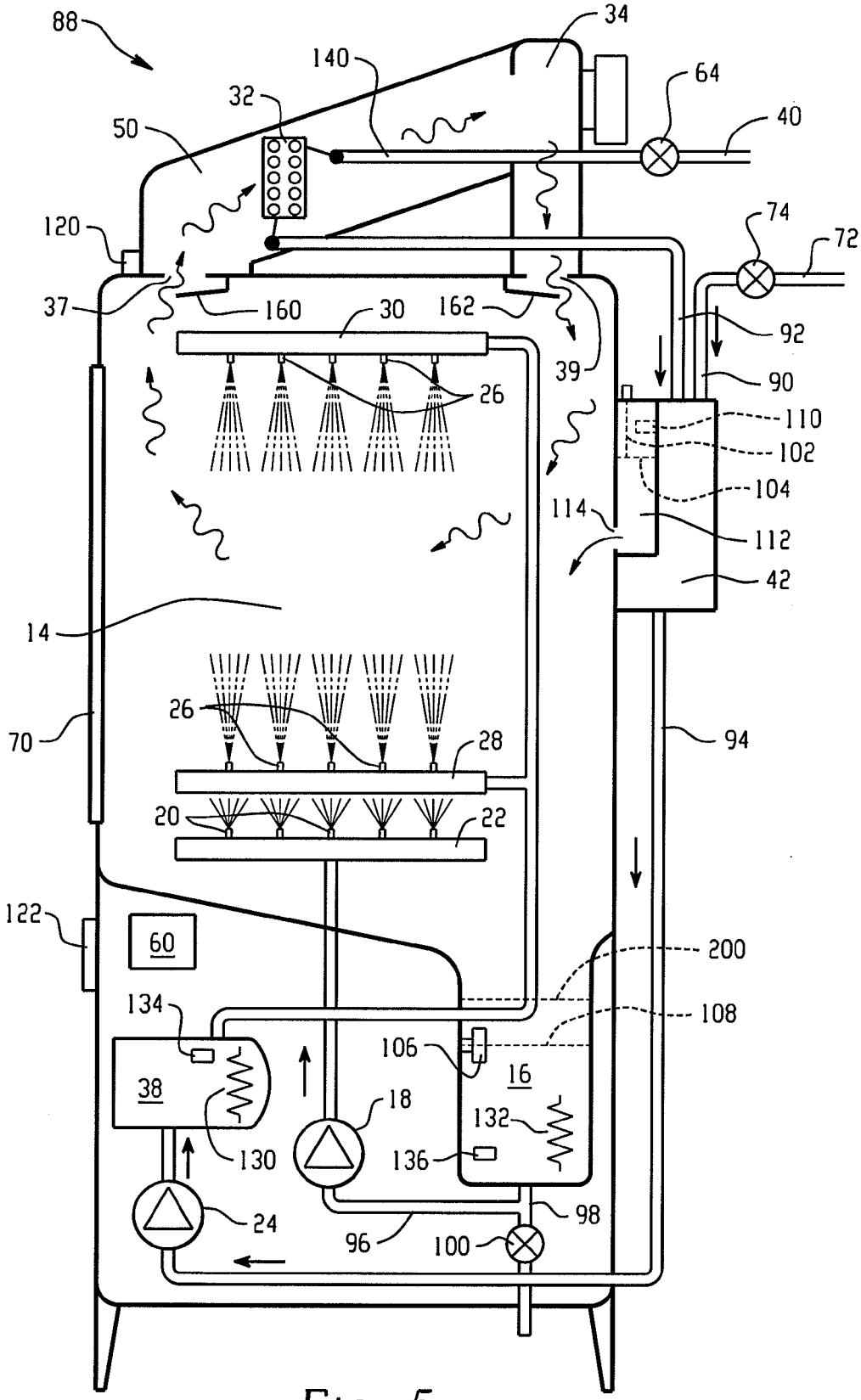
FIG. 5 is a schematic depiction of another embodiment of a dishwasher.
Figure 6:
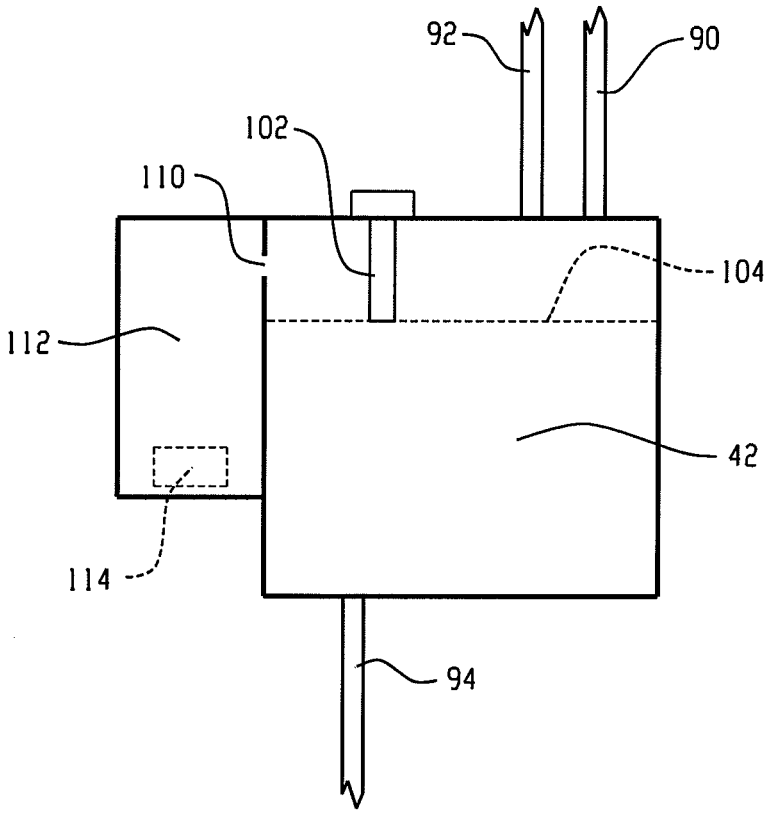
FIG. 6 is a partial schematic rear view of the dishwasher of FIG. 5 showing the rinse reservoir and overflow tank.

Referring now to FIGS. 5 and 6, another embodiment is shown, where the dishwasher 88 includes the heat exchange compartment 50 above the treatment space 14, with the heat exchanger 32 in the form of a coil and the blower 34 (e.g., a centrifugal blower) downstream of the of the heat exchanger. The rinse water reservoir or tank 42 is located lower than the compartment 50, at the back side of the treatment space and includes an input 90 for receiving water directly from a hot water input 72 under control of a valve 74, and an input 92 for receiving water that has passed through the heat exchanger 32 under control of a valve 64 associated with a cold water input 40. A bottom-located output line 94 delivers water from the reservoir 42 to the booster tank 38 via operation of the pump 24. The booster tank 38 is connected to deliver hot water to the rinse arms 28 and 30 for spraying from the rinse arm nozzles 26. The sump tank 16 is connected via line 96 and pump 18 to wash arm (s) 22 for spraying from wash arm nozzles 20. Sprayed water falls back down into the sump tank 16 to be sprayed again in a recirculating manner. The sump tank 16 can also be drained (fully or partially) via drain line 98 under control of valve 100.

The rinse water reservoir 42 includes a water level sensor or detector 102 (e.g., a conductivity probe) for identifying a fill level 104, and the sump tank 16 includes water level detector 106 (e.g., a float valve) for identifying a fill level 108. The rinse water reservoir 42 includes an overflow outlet 110 to an overflow tank 112 located alongside the reservoir 42, where the overflow outlet 110 is located above the fill level 104 detected by probe 102. The overflow tank 112 includes an outlet 114 that feeds into the treatment space so that water from the tank will be delivered down into the sump tank 16. The overflow tank 112 could alternatively include a line connection to an upper portion of the sump tank 16. The outlet 110 is spaced vertically above the outlet 114 to assure that any detergent laden liquid that might enter the overflow tank 112 during a washing operation cannot make its way into the rinse water reservoir 42.

A cycle light 120 is located at the front top of the machine for identifying when a cleaning cycle is running, and an interface 122 with associated display is located at the front of machine below the door 70 for enabling an operator to initiate operations of the machine and for communicating information to the operator. Both the booster 38 and sump tank will typically include respective heating elements 130 and 132 for heating water and respective temperature detectors 134 and 136 to enable temperature control. A controller 60 is connected to the blower 34, water level detectors, valves, pumps, heating elements, temperature sensors, cycle light 120 and interface 122 for control of machine operations, which are explained in further detail below.

For an initial fill operation of the machine, the cycle light 120 is OFF. The hot water valve 74 is opened to fill the machine. Hot water flows into the rinse water reservoir 42 and is delivered to the booster 38 in order to fill the booster. In this regard, the pump may be of a configuration that the head pressure from the reservoir is sufficient to push the water through the pump into the booster 38, even when the pump is OFF. The hot water valve is maintained open, so that the rinse water reservoir 42 begins to fill after the booster 38 is full. When the water level in the reservoir 42 reaches the overflow 110 water flows into the overflow tank 112 and then through the opening 114 and down into the sump tank 16 to fill the sump tank. When the sump tank water level detector indicates that water in the sump tank has reached the fill level 108, the controller keeps the hot water valve open for an additional time period so that the water reaches the full line 200. The additional time period is a calculated time period based upon how long the fill took to reach the fill level 108. The hot water valve 74 is then closed. The machine is now ready for cleaning operations.

At any time after the first (initial) fill cycle, a maintenance fill cycle will be initiated if the main tank float detector 106 is open when the chamber door is opened and then closed. A door open/closed sensor 130 (e.g., a mechanical or magnetic switch) is provided for detecting this condition. A main tank triggered maintenance fill behaves the same as in the initial fill cycle description above. The machine will not be allowed to operate normally until this cycle completes successfully. A maintenance fill cycle will also be initiated if the rinse reservoir's water level probe 102 reads dry (i.e., the water level is below the fill level 104). The rinse reservoir triggered maintenance fill occurs during a normal wash cycle and does not prevent operation of the machine. If, at the beginning of a regular wash cycle, the water probe 102 in the reservoir 42 reads dry, the machine will energize (i.e., open) the hot fill valve 74 to refill the reservoir 42. The valve 74 will remain open until the probe 102 reads wet or the door 70 is opened. This maintenance fill happens automatically in the background and the wash cycle proceeds as normal.

A wash cycle or cleaning cycle includes, in sequence, a wash spray operation, a rinse spray operation, a dwell and a condensing cycle. The following discussion assumes that the door remains closed for the entire cycle. When a cleaning cycle is initiated, the cycle light 120 is turned ON and the pump 18 is operated to deliver water from the sump tank 16 to the wash arm 22 for spraying wash water on the wares from the nozzles 20 for a set time period in a recirculating manner. This wash water is typically maintained at a temperature of at least 140 degrees F. (e.g., about 150 degrees F. or more) and the wash water spraying step may be carried out for a set time period of between 30 and 360 seconds (e.g., a typical machine may include a number of selectable cleaning cycles (e.g., one minute, two minute, four minute and six minute cycles) with differing wash water spraying durations according to the degree of ware soiling). In some embodiments the set time period may be automatically extended if the water temperature in the booster heater has not reached a desired rinse temperature.

At the conclusion of the wash spraying operation the pump 18 is turned OFF and the pump 24 is turned ON to initiate the rinse spraying operation of the cleaning cycle. Rinse water is delivered from the reservoir 42 through the booster 38 and into the rinse arms 28 and 30 for spraying from the spray nozzles 26. The booster 38 may be controlled to deliver the rinse water at a temperature of at least 170 degrees F. (e.g., about 180 F.) for a set time period of between 5 and 30 seconds (e.g., about 10-20 seconds). At the conclusion of the set rinse time period the rinse pump 24 is turned OFF and a dwell period is initiated. By way of example, the dwell period may be from 3 to 15 seconds (e.g., about 6 to 9 seconds).

At the conclusion of the dwell operation, a condensing operation is initiated. During the condensing operation the display of interface 122 shows countdown of time as indication that condensing cycle is running and how long before it ends. The blower 34 turns ON for at least 20 seconds (e.g., at least 25 seconds and more preferably at least 30 seconds) and pulls vapor laden air through the opening 37 from the front at the top of the treatment space 14 through the fins of the heat exchanger 32 and then pushes the air back into the treatment space 14 through opening 39 in the top at the back of the space 14. Baffles 160 and 162 may be provided adjacent each opening to aid in assuring that air flow does not short circuit across the top of the treatment space from opening 39 to opening 37. The cold water valve 64 is opened at the same time as the blower is turned ON, for at least 20 seconds (e.g., at least 25 seconds and more preferably at least 30 seconds). Cold water travels through the tubes of the heat exchanger and is heated up by the hot humid air moved by the blower 34. The water then flows into the reservoir 42 to be used for the rinse spray operation of the next cleaning cycle.

Moisture in the air condenses on the relatively cool heat exchanger 34 and the condensate reenters the treatment space at the rear of the machine. A pressure compensating flow restrictor may be provided in the line 140 that feeds the heat exchanger 32 in order to regulate the flow of cold water through the coil to maintain proper heat transfer regardless of incoming line pressure. The condensing operation ends after a set time period, and the cycle light 120 turns OFF. The valve 64 is closed at this time, but the blower 34 stays ON for some time period (e.g., at least 5 minutes, or about 10 minutes) after the condensing operation is completed, unless the door 70 is opened, in which case the blower 34 is turned OFF sooner.

In the event of a shortened condensing operation (e.g., the door 70 is opened before the end of the condensing operation), the blower 34 turns OFF and the cold water valve 64 is closed. The entire condensing operation is reset and starts from the beginning when the door 70 is closed again.

In some embodiments, the controller 60 may be configured to adjust for variance of the rinse spray duration of the cleaning cycle. Specifically, for a standard cycle with a set rinse duration the condensing operation may have a corresponding set duration. If the rinse duration is adjusted via the interface 122, the controller 60 automatically adjusts the duration of the condensing operation accordingly. In one example, for every second of increase in the rinse duration, 3 seconds of extra condensing time is added. This adjustment helps insure that the rinse water reservoir 42 is not depleted during the longer rinse. It also gives more time for the water vapor to be condensed. Increasing the duration of the condensation operation may also be beneficial where the temperature of the incoming water at inlet 40 is supplied at an above normal temperature (e.g., higher than about 60 to 65 degrees). In this regard, the controller 60 and interface may enable an operator or service person to designate the temperature of the incoming cold water, and the controller selects an appropriate duration for condensing operations. Alternatively, an additional temperature probe could be provided to detect the temperature of the incoming water so that the controller 60 would automatically adjust the duration of the condensing operation if the incoming water temperature was too high.

It is to be clearly understood that the above description is intended by way of illustration and example only, is not intended to be taken by way of limitation, and that other changes and modifications are possible.

What is claimed is:

1. A box-type warewasher for washing wares, the warewasher comprising:

a housing defining an internal treatment space for receiving wares to be washed and a liquid sump below the treatment space;

a wash liquid delivery system that provides a spray of liquid within the treatment space, including a wash pump having an input connected to the liquid sump and an output connected to deliver liquid to one or more spray nozzles of the treatment space;

a rinse liquid delivery system including a rinse pump for delivering rinse water to one or more spray nozzles of the treatment space;

a closed loop heat recovery system for recovering heat from hot moist air present in the treatment space, the heat recovery system including a heat exchanger external of the treatment space, a blower for moving hot moist air from the treatment space across the heat exchanger and back to the treatment space:

wherein the heat exchanger is located in a heat exchange compartment that is adjacent the treatment space, the heat exchange compartment having an inlet opening from the treatment space to the heat exchange compartment and an outlet opening from the heat exchange compartment to the treatment space, the blower located between the inlet opening and the outlet opening to circulate hot moist air from the treatment space into the heat exchange compartment, across the heat exchanger and back into the treatment space, and the heat exchanger is a heat exchange coil through which cold water flows so as to pick up heat from the hot moist air flowing past the heat exchanger;

a programmed controller is associated with the wash liquid delivery system, rinse liquid delivery system and heat recovery system, the programmed controller configured for carrying out at least one ware treatment program sequence in which:

(i) the wash liquid delivery system is operated for spraying hot wash liquid onto wares in the treatment space;

(ii) subsequent to spraying of wash liquid, the rinse liquid delivery system is operated for spraying hot rinse liquid onto wares in the treatment space; and (iii) subsequent to spraying of rinse liquid, the heat recovery system is operated to move hot moist air from the treatment space, into the heat exchange compartment and back to the treatment space to reduce moisture level of air in the treatment space prior to completion of the ware treatment program sequence;

wherein the programmed controller is configured such that the heat recovery system is operated as a final step of the ware treatment program sequence, upon completion of the heat recovery step a cycle complete indicator at an external surface of the warewasher is triggered to identify cycle completion for an operator;

wherein a duration of the heat recovery step is between about 10 seconds and about 60 seconds.

2. The box-type warewasher of claim 1 wherein the rinse liquid delivery system includes a booster heater, the rinse pump delivers water from the booster heater to one or more spray nozzles of the treatment space.

3. A box-type warewasher for washing wares, the warewasher comprising:

a housing defining an internal treatment space for receiving wares to be washed and a liquid sump below the treatment space;

a wash liquid delivery system that provides a spray of liquid within the treatment space, including a wash pump having an input connected to the liquid sump and an output connected to deliver liquid to one or more spray nozzles of the treatment space;

a rinse liquid delivery system for delivering rinse water to one or more spray nozzles of the treatment space;

a closed loop heat recovery system for recovering heat from hot moist air present in the treatment space, the heat recovery system including a heat exchanger external of the treatment space, a blower for moving hot moist air from the treatment space across the heat exchanger and back to the treatment space;

wherein the heat exchanger is located in a heat exchange compartment that is adjacent the treatment space, the heat exchange compartment having an inlet opening from the treatment space to the heat exchange compartment and an outlet opening from the heat exchange compartment to the treatment space, the blower located to circulate hot moist air from the treatment space into the heat exchange compartment, across the heat exchanger and back into the treatment space, and the heat exchanger is a heat exchange coil through which cold water flows so as to pick up heat from the hot moist air flowing past the heat exchanger;

a cold water input connected to deliver cold water to the heat exchanger such that heat recovered from hot moist air is transferred to the cold water;

a rinse water reservoir that receives heated water from the heat exchanger, the rinse water reservoir connected to deliver water to a booster heater of the rinse liquid delivery system, the rinse water reservoir further including a hot water input connected to an external source of hot water, and an overflow for delivering excessive water inflows from either the heat exchanger or the water input to the liquid sump.

4. The box-type warewasher of claim 3 wherein heated water from the heat exchanger is at least 15 degrees F. hotter than cold water delivered to the heat exchanger.

5. The box-type warewasher of claim 3 wherein heated water from the heat exchanger is at least 40 degrees F. hotter than cold water delivered to the heat exchanger.

6. The box-type warewasher of claim 3, further comprising a path for flowing condensed moisture from the heat exchanger back into the treatment space.

7. The box-type warewasher of claim 1 wherein the duration of the heat recovery step is between about 20 seconds and about 40 seconds.

8. A box-type warewasher for washing wares, the warewasher comprising:

a housing defining an internal treatment space for receiving wares to be washed and a liquid sump below the treatment space;

a wash liquid delivery system that provides a spray of liquid within the treatment space, including a wash pump having an input connected to the liquid sump and an output connected to deliver liquid to one or more spray nozzles of the treatment space;

a rinse liquid delivery system including a rinse pump for delivering rinse water to one or more spray nozzles of the treatment space;

a closed loop heat recovery system for recovering heat from hot moist air present in the treatment space, the heat recovery system including a heat exchanger external of the treatment space, a blower for moving hot moist air from the treatment space across the heat exchanger and back to the treatment space;

wherein the rinse liquid delivery system includes a booster heater, the rinse pump delivers water from the booster heater to one or more spray nozzles of the treatment space a cold water input connected to deliver cold water to the heat exchanger such that heat recovered from hot moist air is transferred to the cold water;

a rinse water reservoir that receives heated water from the heat exchanger, the rinse water reservoir connected to deliver water to the booster heater;

an overflow tank including an outlet for delivering water to the sump;

a hot water input connected to deliver hot water to the rinse water reservoir;

wherein the rinse water reservoir includes an overflow outlet for delivering water to the overflow tank, a controller is configured for carrying out an initial fill operation in which that the sump is filled with hot water by delivering hot water into the rinse water reservoir, overflowing the hot water from the rinse water reservoir into the overflow tank and allowing the hot water to flow from the overflow tank outlet to the sump.

9. A warewasher for washing wares, the warewasher comprising:

a housing defining an internal treatment space for receiving wares to be washed and a liquid sump below the treatment space, a door associated with the housing for moving wares into and out of the treatment space;

a wash liquid delivery system that provides a spray of liquid within the treatment space, including a wash pump having an input connected to the liquid sump and an output connected to deliver liquid to one or more spray nozzles of the treatment space;

a rinse liquid delivery system including a rinse pump for delivering rinse water to one or more spray nozzles of the treatment space;

a condensing system for removing moisture from air present in the treatment space, the condensing system including a heat exchanger external of the treatment space, and a blower for moving hot moist air from the treatment space across the heat exchanger and back to the treatment space; and a controller for effecting operation of each of the wash liquid delivery system, the rinse liquid deliver system and the condensing system, the controller configured for carrying out at least one ware cleaning sequence in which:

a wash spray operation is carried out by operating the wash pump;

subsequent to the wash spray operation a rinse spray operation is carried out by operating the rinse pump; and subsequent to the rinse spray operation a condensing operation is carried out by operating the blower; and wherein the controller is configured to permit adjustment of rinse spray operation duration and, if rinse spray operation is increased, the controller operates so that a set duration for the condensing operation is also increased.

10. The warewasher of claim 9 further comprising:

the rinse liquid delivery system includes a booster heater, the rinse pump moves water from the booster heater to one or more spray nozzles of the treatment space;

a cold water input connected to deliver cold water to the heat exchanger such that heat recovered from hot moist air is transferred to the cold water; and a rinse water reservoir that receives heated water from the heat exchanger, the rinse water reservoir connected to deliver water to the booster heater via the wash pump.

11. The warewasher of claim 10, further comprising:

an overflow tank including an outlet for delivering water to the sump;

a hot water input connected to deliver hot water to the rinse water reservoir;

wherein the rinse water reservoir includes an overflow outlet for delivering water to the overflow tank, during an initial fill operation controller operates such that the sump is filled with hot water by delivering hot water into the rinse water reservoir, overflowing the hot water from the rinse water reservoir into the overflow tank and allowing the hot water to flow from the overflow tank outlet to the sump.

12. The warewasher of claim 11, wherein:

the rinse water reservoir and overflow tank are mounted at elevations higher than the sump, the outlet of the overflow tank leads to the treatment space, and hot water passing through the outlet into the treatment space falls downward into the sump.

13. The warewasher of claim 10, wherein:

a cold water valve controls flow of cold water from the cold water input through the heat exchanger;

the controller is configured such that during the condensing operation both the blower is turned ON and the cold water valve is opened and, subsequently, the cold water valve is closed but the blower is maintained ON.

14. The warewasher of claim 13 wherein closing of the cold water valve indicates an end of the cleaning cycle and the controller is configured such that after closing of the cold water valve the blower is maintained ON until either the door is opened or a set time period passes.

15. The warewasher of claim 9 wherein an air inlet delivers air from the treatment space to the to the heat exchanger and an air outlet delivers air back into the treatment space, the air inlet and air outlet spaced apart at the top of the treatment space, and at least one baffle is located to prevent short circuit air flow from the air outlet to the air inlet.

* * * * *